US005519999A

United States Patent [19]

Harpole et al.

[11] Patent Number: 5,519,999

[45] Date of Patent: May 28, 1996

[54] FLOW TURNING CRYOGENIC HEAT EXCHANGER

[75] Inventors: George M. Harpole, San Pedro; William W. Burt, Hawthorne, both of Calif.

[73] Assignee: TRW Inc., Redondo Beach, Calif.

[21] Appl. No.: 286,565

[22] Filed: Aug. 5, 1994

[51] Int. Cl.[6] ..... F25B 9/00

[52] U.S. Cl. ..... 62/6; 62/467; 60/520

[58] Field of Search ..... 62/6, 467; 60/520

[56] References Cited

U.S. PATENT DOCUMENTS

| | | | |
|---|---|---|---|
| 5,107,683 | 4/1992 | Chan et al. | 62/6 |
| 5,269,147 | 12/1993 | Ishizaki et al. | 62/6 |
| 5,275,002 | 1/1994 | Inoue et al. | 62/6 |

OTHER PUBLICATIONS

Tward, et al. Article entitled "Pulse Tube Refrigerator Performance," Preprint Advances in Cryogenic Engineering, V35, (1989).

C. K. Chan, et al., Article entitled "Miniature Pulse Tube Cooler," 7th Int'l Cryocooler Conference, Apr. 1993.

*Primary Examiner*—Ronald C. Capossela

[57] ABSTRACT

A cryogenic heat exchanger, such as a pulse tube cryogenic heat exchanger, is provided wherein the chilled heat transfer connection point can be conveniently disposed at an "apex." The heat exchanger has a bridging chamber with a first opening and a second opening. Disposed within the bridging chamber is a plurality of fins disposed longitudinally between the first opening and the second opening so as to partition the bridging chamber into a plurality of parallel longitudinal channels of equal cross-section. The first opening and the second opening are disposed at an angle to one another, so that a heat transfer gas flowing through the heat exchanger, changes direction within the bridging chamber.

17 Claims, 4 Drawing Sheets

FLOW TURNING CRYOGENIC HEAT EXCHANGER

BACKGROUND

This invention relates generally to cryogenic heat exchangers and, specifically, to pulse tube cryogenic heat exchangers.

BACKGROUND OF THE INVENTION

Cryogenic heat exchangers have been in common use for many years. One type of cryogenic heat exchanger is a closed-cycle expansion cooler which provides cooling through the alternating compression and expansion of a gas. Typical closed-cycle expansion coolers of this type include heat exchangers commonly termed "Sterling coolers," "Vuilleumier coolers," "Gifford-McMahon coolers," "Joule-Thomson coolers," and "pulse tube coolers."

Pulse tube coolers are particular attractive for applications within space craft because of their simplicity, reliability, and high efficiency.

Unfortunately, pulse tube coolers of the prior art have the common drawback that the cooling load heat exchanger portion of the cooler is located towards the middle of an elongated, linear, tubular housing. This location of the cooling load heat exchanger makes it difficult to install the pulse tube cooler in close proximity to the object or equipment which needs cooling.

There is therefore a need for a pulse tube cooler which can be conveniently located in close proximity to the object or equipment to be cooled.

SUMMARY OF THE INVENTION

The present invention satisfies this need. The invention is a pulse tube cooler configured so that the cooling load heat exchanger is easily accessible to the object or equipment to be cooled.

The invention comprises a hollow pulse tube, a regenerator, a cooling load heat exchanger, and pressure wave generator. The cooling load heat exchanger has a bridging chamber with a flow path which connects the cold end of the regenerator in fluid communication with the cold end of the pulse tube. The internal volume of the cooling load heat exchanger is less than the displacement volume of the flow of working gas generated by the pressure wave generator under conditions of low pressure drop through the bridging chamber. When the pulse tube cooler of the invention is filled with a working gas, the pressure wave generator causes the working gas to flow serially from the regenerator, through the cooling load heat exchanger and through the pulse tube. The bridging chamber is configured so that the flow of working gas is caused to change direction from the direction that it enters the bridging chamber to a different direction that it exits the bridging chamber. Thus, the cooling load heat exchanger is not disposed in the middle of an elongated, linear housing. Rather, it is conveniently disposed at an apex within the housing.

In one embodiment of the invention, the bridging chamber comprises a plurality of fins disposed longitudinally within the bridging chamber, so as to partition the bridging chamber into a plurality of parallel longitudinal channels of equal cross-section. It has been found that the flow or working gas within such parallel channels allows the cooling load heat exchanger to be of minimum volume and results in minimum pressure drop when working gas flows through the bridging chamber.

The cooling load heat exchanger is disposed at an apex between the regenerator means and the pulse tube. This apex can be modest (angle between incoming gas and outgoing gas of 90°–180°), or it can be pronounced (angle between incoming gas and outgoing gas of less than 90°). In one embodiment, the cooling load heat exchanger is disposed at a most pronounced apex wherein the outgoing gas flows at precisely the opposite direction of the incoming gas (angle between the incoming gas and the outgoing gas of 0°).

The invention is relatively simple and inexpensive to manufacture, and provides excellent cooling efficiencies. The invention is ideal for use within the close confines of a space craft wherein it can be easily disposed in close proximity to the object or item of equipment in need of cooling.

DESCRIPTION OF DRAWINGS

These and other features, aspects and advantages of the present invention will become better understood with reference to the following description, appended claims and accompanying drawings where:

DETAILED DESCRIPTION OF THE INVENTION

Figure 1:
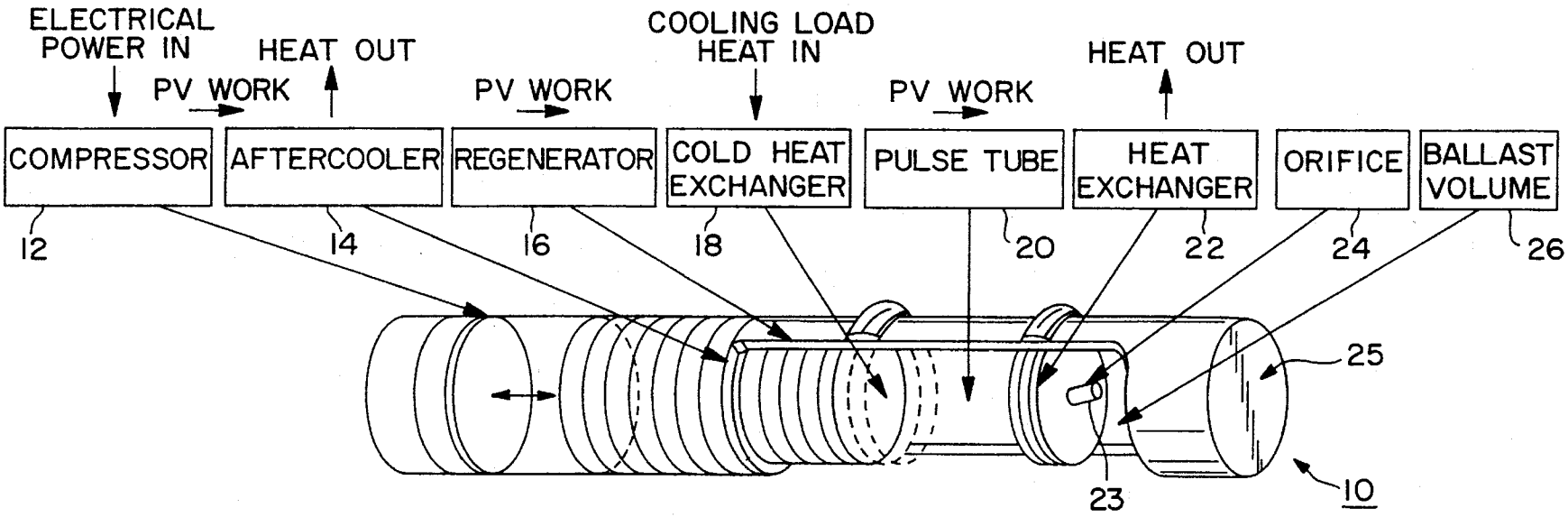
FIG. 1 PRIOR ART
FIG. 1 is a prospective view in partial cutaway of a pulse tube cooler of the prior art.
Figure 2:
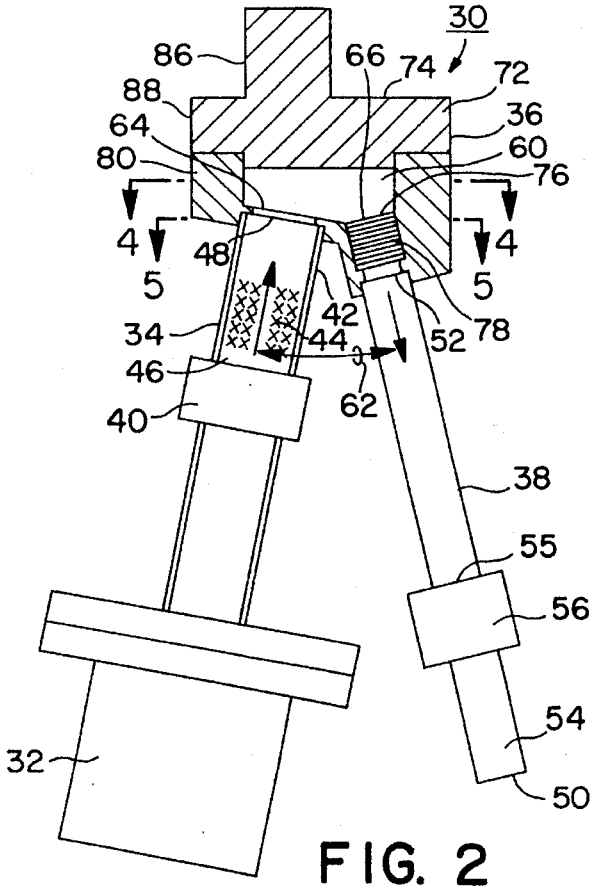
FIG. 2 is a cross-sectional side view of a cooler having properties of the invention.
Figure 5:
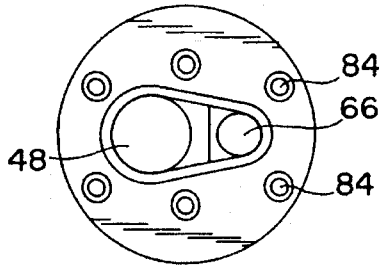
FIG. 5 is a detail view within the cooling load heat exchanger of the embodiment of FIG. 2 taken along line 5—5.
Figure 6:
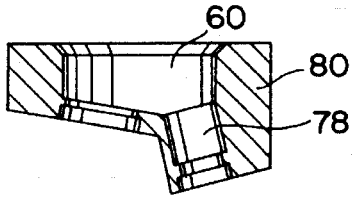
FIG. 6 is a detailed view of the bridging chamber of the cooling load heat exchanger in the embodiment shown in FIG. 2.

Pulse tube coolers and their operation are described in detail in U.S. Pat. No. 5,107,683 (Chan), the entire contents of which are incorporated herein by reference. Referring to FIG. 1, a generalized pulse tube cooler 10 of the prior art is a simple heat pump which pumps heat from a cooling load to a heat sink, such as the ambient environment.

In the embodiment shown in FIG. 1, the pulse tube cooler 10 includes, in series, a pressure wave generator 12, an aftercooler 14, a regenerator 16, a cooling load heat exchanger 18, a pulse tube 20, a hot end heat exchanger 22 and a ballast volume 26. When in operation, the pulse tube cooler 10 is filled with a working gas, such as helium.

The pressure wave generator 12, which is the only component with moving parts, is typically a piston type compressor.

The regenerator 16 acts as a thermal sponge, alternately absorbing heat from the working gas and rejecting excess heat to the working gas as the pressure waves travel back and forth. The regenerator 16 typically comprises a stack of screens. Packed spheres or parallel plates may also be used instead of the stacked screens. The regenerator must have a large heat capacity compared with that of the gas. It must also have a low thermal conductivity to minimize conduction losses. The operating efficiency of the pulse tube cooler 10 depends in large part on the efficiency of the heat transfer between the regenerator 16 and the working gas. Thus, where the regenerator comprises a stack of screens, the efficiency of the regenerator 16 is determined by the screen mesh size and the materials used in fabricating the screens.

The pulse tube 20 is a thin-walled tube which has a low thermal conductivity. The cold heat exchange in 18, and the heat exchange 22 define the boundaries of the pulse tube 20. In line with the pulse tube is the ballast reservoir 26. The reservoir 26 controls the expansion and contraction oscillations of the helium gas. The helium gas passing through the heat exchanger is transitioned to the ballast volume through the orifice 24 and the interconnect tube 23.

The aftercooler 14, the cooling load heat exchanger 18 and the hot end heat exchanger 22 are typically stacks of screens of high thermal conductivity such as screens made of copper. These screens are thermally connected to copper blocks. The aftercooler 14 and the hot end heat exchanger 22 are typically cooled by heat conduction or heat pipe transport to a local radiator surface or by use of a forced flow coolant loop.

In operation, the pulse tube cooler 10 is filled with the working gas. The pressure wave generator 12 generates pressure waves within the working gas at a predetermined frequency. Each pressure wave travels the length of the pulse tube cooler 10. The compression of the gas initially increases the temperature of the gas to above ambient temperature. However, the heat of compression is substantially removed by the aftercooler 14. Thereafter, the gas is cooled to well below ambient temperature by contact with the regenerator 16 and by expansion of the gas as it enters the pulse tube 20. The alternating pressure waves generated by the pressure wave generator 12 produce pressure/volume (PV) work which causes the regenerator 16 to pump heat from the cooling load (not shown) to a heat sink (also not shown). The result of this heat pumping action is to lower the temperature of the cooling load. Meanwhile, part of the PV work travels down the pulse tube 20, where it is rejected as heat to the heat sink by the hot end heat exchanger 22.

As illustrated in FIG. 1, cooling load heat exchangers of prior art pulse tube coolers are disposed approximately midway along the elongated, linear pulse tube cooler housing. This makes the transfer of heat from the object or equipment to be cooled to the cooling load heat exchanger relatively difficult and awkward.

In contrast, the improved pulse tube cooler of the invention 30 is disposed at an "apex" within the pulse tube cooler housing. The pulse tube cooler of the invention 30 is non-linear at the cooling load heat exchanger. It is generally V-shaped with the cooling load heat exchanger disposed at the base of the V.

As illustrated in FIGS. 2–11. the improved pulse tube cooler 30 comprises a pressure wave generator 32, a regenerator 34, a cooling load heat exchanger 36 and a hollow pulse tube 38.

Like pressure wave generators used in the prior art, the pressure wave generator 32 used in the invention 30 is typically a piston type compressor. Generally the volume of cooling load heat exchanger is in the range of 2% to 10% of the gas volume generated by the stroke of the compressor 32. Other pressure wave generating devices know in the art can be used as well. The pressure wave generator 32 causes waves to be propagated within the working gas, each wave having a discrete displacement volume.

Like pulse tube coolers of the prior art, in the invention 30 an aftercooler 40 is typically disposed immediately downstream of the pressure wave generator 32 to remove the heat of compression from a working gas disposed within the pulse tube cooler 30 and to reject that heat to a heat sink (not shown).

As in pulse tube coolers of the prior art, the regenerator 34 used in the invention 30 typically comprises a housing 42 wherein is disposed a stack of screens 44. Packed spheres or parallel plates may also be used instead of the stacked screens. The regenerator 34 typically is adapted to absorb heat from working gas having a temperature warmer than the regenerator 34 and to reject heat to working gas having a temperature cooler than the regenerator 34. The regenerator 34 must have, therefore, a large heat capacity compared with that of the working gas. It must also have a low thermal conductivity to minimize conduction losses. The regenerator 34 has a first end 46 and a second end 48.

As in pulse tube coolers of the prior art, the pulse tube 38 used in the invention is a thin-walled tube which has a low thermal conductivity. The pulse tube 38 is capped at one end by an end wall 50. The pulse tube 38 has a cold end 52 and a hot end 55.

Also as in pulse tube coolers of the prior art, a hot end heat exchanger 56 is typically disposed within the pulse tube 38 spaced apart from the end wall 50 so as to form a ballast volume 54 therebetween. The hot end heat exchanger 56 removes heat from the working gas and rejects that heat to the heat sink.

As in pulse tube coolers of the prior art, the cooling load heat exchanger 36 is disposed between the second end 48 of the regenerator and the cold end 52 of the pulse tube 38. The cooling load heat exchanger 36 is adapted to absorb heat from the cooling load and reject that heat to the working gas.

Unlike pulse tube coolers of the prior art, however, the cooling load heat exchanger 36 is disposed at an "apex" between the regenerator 34 and the pulse tube 38. The cooling load heat exchanger 36 comprises a bridging chamber 60 with a flow path which connects the second end 48 of the regenerator 34 to the cold end 52 of the pulse tube 38. The bridging chamber 60 redirects the flow of gas within the pulse tube cooler 30 from a first direction in which the gas enters the cooling load heat exchanger 36 to a second direction in which the gas exits the cooling load heat exchanger 36. The change of direction can be moderate (wherein the angle 62 between the incoming gas and the outgoing gas is between 90° and 180°) or it can be pronounced (wherein the angle 62 between the incoming gas and the out going gas is less than 90°). In the embodiment illustrated in FIGS. 2–11. the change of direction is pronounced. It will be appreciated that the fins 68, best shown in FIG. 11, are tapered. The fin dimension is thicker at the regenerator port 64 than at the pulse tube, port 66. The tapered fin accomplishes a volume matching of the gas oscillating between the smaller pulse tube area 66 and the larger regenerator area 64. Tapering avoids problems such as the variations in the length of the channels 70; larger pressure drop in the regenerators or the need for a plenum between the heat exchanger and the regenerator.

Figure 10:
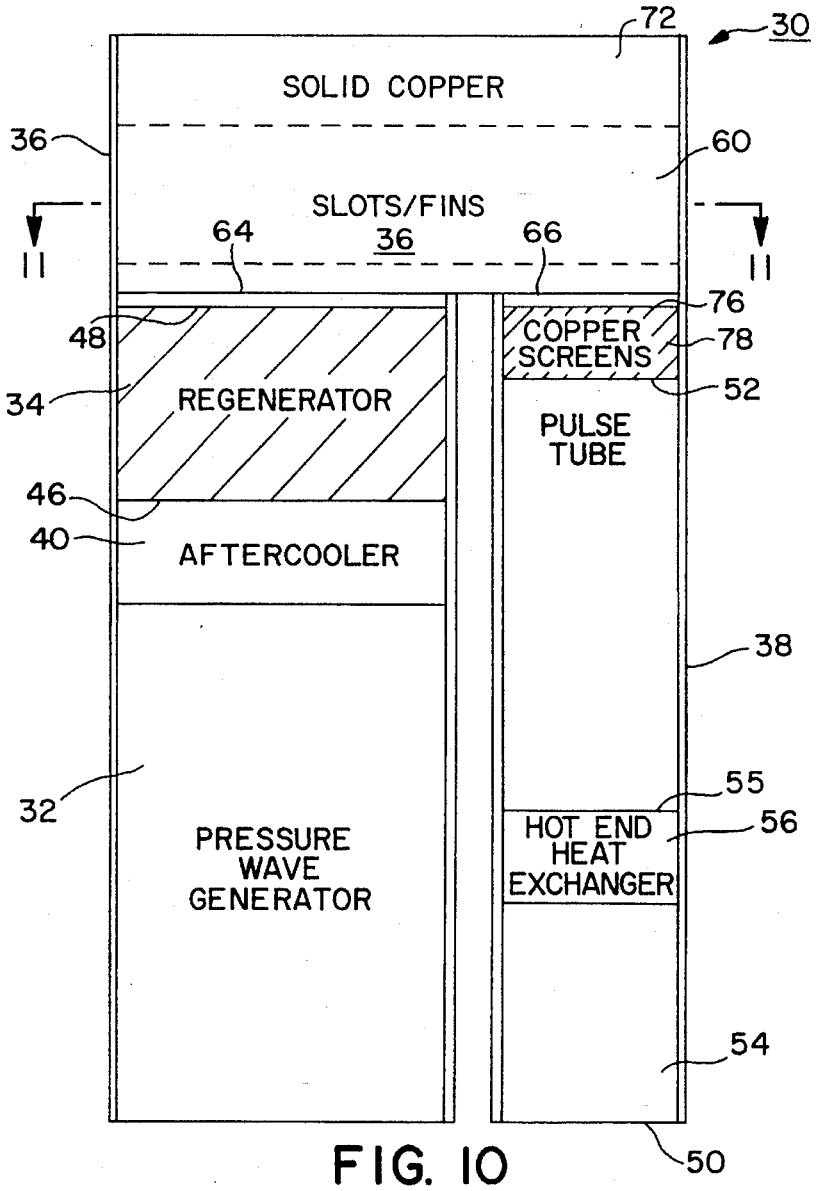
FIG. 10 is a cross-sectional side view of a second embodiment of a cooler having features of the invention.
Figure 11:
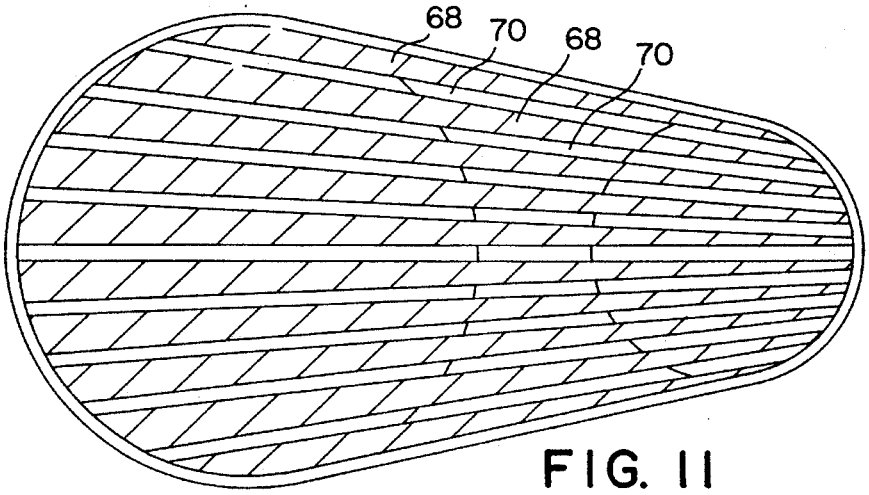
FIG. 11 is a cross-sectional view of the bridging chamber within the cooling load heat exchanger in the embodiment shown in FIG. 10 taken along line 11—11.

In the embodiment illustrated in FIGS. 10–11, the change of direction is most pronounced, in that the direction of the incoming gas is essentially opposite the direction of the outgoing gas (the angle 62 between the incoming gas and outgoing gas is essentially 0°). Preferably, the change of direction is at least about 150° so as to provide sufficient "apex" for the convenient installation of the pulse tube cooler 10 in proximate relation to the cooling load.

The internal volume of the cooling load heat exchanger 36 is less than the displacement volume of the pressure waves generated by the pressure wave generator 32 under conditions of low pressure drop through the bridging chamber 60.

In the embodiments shown in the drawings, the bridging chamber 60 has a first opening 64 in fluid communication with the regenerator 34 and a second opening 66 in fluid communication with the pulse tube 38. The bridging chamber 60 further comprises a plurality of fins 68 disposed longitudinally between the first opening 64 of the bridging chamber and the second opening 66 of the bridging chamber 60 so as to partition the bridging chamber 60 into a plurality of parallel longitudinal channels 70. To minimize pressure drop and volume of gas flowing within the channels 70, it is preferable that the channels 70 be of equal cross-section. In a typical embodiment for (1.2 Watts at 80 K. cooler), the bridging chamber 60 contains between 12 and 15 fins 68, and the distance between each adjoining pair of fins 68 is 0.15 mm. It will be appreciated that depending on the heat loads to be cooled the turn-around heat exchange would require more fins.

In the embodiment illustrated in the drawings, the first opening 64 in the bridging chamber 60 is smaller than the second opening 66 in the bridging chamber 60. It is desirable that the gas be introduced into a low volume path (low pressure drop) into the channels 70 at the regenerator end 48. In this embodiment, in order for the channels 70 to be of equal distance from one another, so that gas at all points at the regenerator second end 48 has a short distance (low volume) and low pressure drop path into the channels 70, each fin 68 is thicker at the end proximate to the second opening 66 than at the end proximate to the first opening 64. It will be understood that the fines 68 are in virtual contact with the screens (not shown) of the regenerator 34.

The channels 70 typically extend for about two thirds of the depth of the cooling load heat exchanger 36. A solid copper base 72 is provided at the top of the cooling load heat exchanger 36. A top 74 of the base 72 acts as the surface from which cooling can be imparted to a cooling load.

The channels 70 extend into an aperture 76 of a coupling 78 which couples the second opening 66 of the bridging chamber 60 to the cold end 52 of the pulse tube 38. The aperture 76 is shaped to receive the fins 68 in tight engagement.

The channels 70 permit the smooth flow of gas to flow between the regenerator 34, the cooling load heat exchanger 36 and the pulse tube 38 without substantial pressure drop. The channels 70 represent a substantially constant cross-sectional area. The gas volume is minimized by filling the entire turn with the cooling load heat exchanger 36 and by the constant cross-sectional area.

The cold end 52 of the pulse tube 38 is spaced from the bottom of the fins 68, thereby defining space 78. In the space 78, there is located one or more copper screens. The copper screens 78 facilitate straightening the flow while increasing heat exchanger efficiency.

Preferably the cooling load heat exchanger 36 is in virtual contact (no gap) with the regenerator 34. Also the space between the cooling load heat exchanger 36 and the copper screens in space 78 is a minimum.

Figure 3:
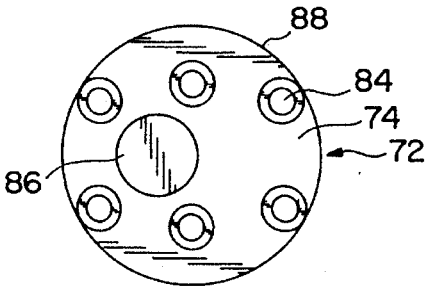
FIG. 3 is a top view of the cooling load heat exchanger used in the cooler of FIG. 2.
Figure 4:
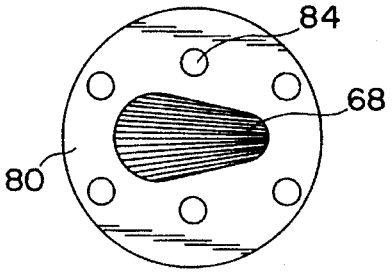
FIG. 4 is a detail view within the cooling load heat exchanger of the embodiment of FIG. 2 taken along line 4—4.
Figure 7:
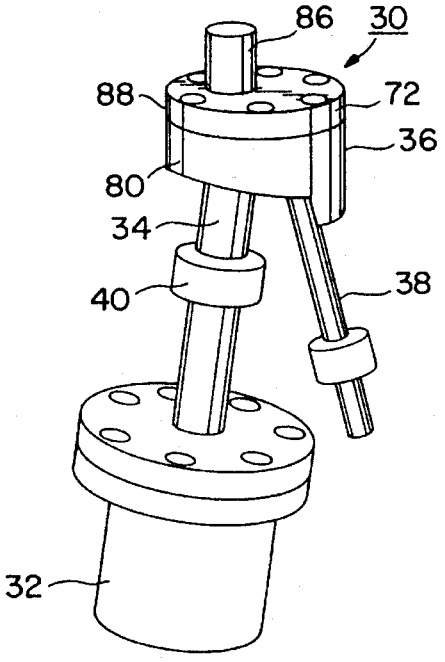
FIG. 7 is a prospective view of the cooler of FIG. 2.
Figure 8:
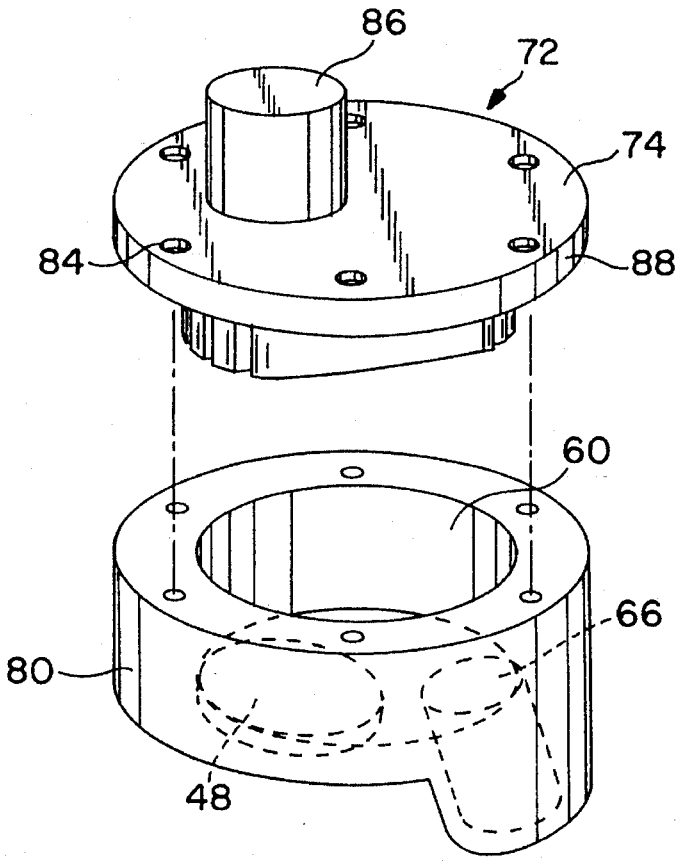
FIG. 8 is a prospective detailed view of a cooling load heat exchanger useful in the embodiment shown in FIG. 2.
Figure 9:
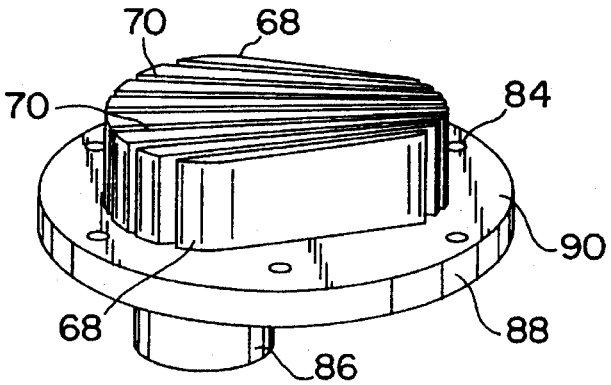
FIG. 9 is a prospective detailed view of a bridging chamber having fins useful in the embodiment shown in FIG. 2.

A coupling 80 fits the copper base 72. The base 72 is further illustrated in FIGS. 3, 8 and 9. In FIG. 3, the base 72 is shown with six-spaced apertures 84 about a proboscis 86 on which a cooling load can be located or mounted. Below the proboscis 86 is a circular flange 88 and below the flange 88 are the fins 68 for forming the channels 70 between them. As shown in FIG. 9, the fins 68 protrude from the underside 90 of the base 72.

The channels 70 are typically cut in the block of copper forming the base 72 as necessary. Any appropriate cutting process can be used to form the channels 70 between the fins 68.

The cooling load heat exchanger 36 achieves effective efficient heat exchange with the gas. There is low-pressure drop, low gas volume and there is direct contact with the regenerator, with the flow turned back in the opposite and near opposite direction. This narrow channel parallel plate type heat exchanger provides for a compact system. The apex at which the cooling load heat exchanger 36 is located provides a convenient location for the effective positioning of a cooling load.

The cooling load heat exchanger 36 used in the pulse tube cooler 10 of the invention is also useful in other applications such as in non-pulse tube cryo-coolers for instance, Stirling and Gifford-McMahon cycles.

Many other forms of the invention exist each differing in matters of detail only. For instance, instead of the first cross-sectional area of the regenerator, and the second cross-sectional area of the tube being circular, other suitable cross-sectional areas can be used. Accordingly, it should be apparent that numerous structural modifications and adaptations may be resorted to without departing from the scope and fair meaning of the instant invention as set forth hereinabove and as described hereinbelow by the claims.

What is claimed is:

1. A pulse tube cooler for cooling a load comprising:

(a) a hollow pulse tube having a cold end;

(b) a regenerator for absorbing heat from a working gas disposed within the regenerator, said regenerator having a first end and a second end;

(c) a cooling load heat exchanger for absorbing heat from the load and transferring that heat to a working gas disposed within the cooling load heat exchanger, the cooling load heat exchanger comprising a bridging chamber with a flow path which connects the cold end of the regenerator in fluid communication with the cold end of the pulse tube:

(d) a pressure wave generator for generating pressure wave oscillations in a working gas disposed within the regenerator proximate to the first end of the regenerator, the pressure wave oscillations causing displacement volumes so that the pressure wave oscillations cause the working gas to flow serially through the regenerator, the cooling load heat exchanger and the pulse tube;

wherein the internal volume of the cooling load heat exchanger is less than the displacement volume of the flow of working gas generated by the pressure wave generator under conditions of low pressure drop through the bridging chamber; and wherein, when the pressure wave generator causes the working gas to flow serially through the regenerator, the cooling load heat exchanger and the pulse tube, the flow path within the bridging chamber causes the flow of the working gas to change direction from the direction that it enters the bridging chamber to a different direction that it exits the bridging chamber.

2. The pulse tube cooler as set forth in claim 1 wherein, when the pressure wave generator causes the working gas to flow serially through the regenerator, the cooling load heat exchanger and the pulse tube, the flow path within the bridging chamber causes the flow of the working gas to change direction from the direction that it enters the bridging chamber to a different direction that it exits the bridging chamber by an angle of between about 0° and about 150° degrees.

3. The pulse cooler as set forth in claim 1 wherein, when the pressure wave generator causes the working gas to flow serially through the regenerator, the cooling load heat exchanger and the pulse tube, the flow path within the bridging chamber causes the flow of the working gas to change direction from the direction that it enters the bridging chamber to a different direction that it exits the bridging chamber by an angle of between about 0° and about 90° degrees.

4. The pulse tube cooler as set forth in claim 1 wherein the internal gas volume of the cooling load heat exchanger is between about 2% and 10% of the volume generated by the compressor stroke.

5. The pulse tube cooler as set forth in claim 1 wherein the bridging chamber has a first opening disposed in fluid communication with the cold end of the regenerator and a second opening disposed in fluid communication with the cold end of the pulse tube, and wherein the bridging chamber further comprises a plurality of fins disposed longitudinally within the bridging chamber between the first opening and the second opening so as to partition the bridging chamber into a plurality of parallel longitudinal channels of equal cross-section disposed between the first opening and the second opening.

6. The pulse tube cooler as set forth in claim 5 wherein the width of the channels is between about 0.07 mm and about 0.4 mm.

7. The pulse tube cooler as set forth in claim 5 wherein the first opening is larger than the second opening.

8. The pulse tube cooler as set forth in claim 1 further comprising an aftercooler for removing heat from a location immediately downstream of the pressure wave generator.

9. A pulse tube cooler for cooling a cooling load comprising:

(a) a pulse tube having a cold end and a closed hot end;

(b) a hot end heat exchanger for removing heat from the pulse tube at a location proximate to the hot end of the pulse tube;

(c) a regenerator for absorbing heat from a working gas having a temperature warmer than that of the regenerator and for rejecting heat to a working gas having a temperature cooler than that of the regenerator, the regenerator having a first end and a second end;

(d) a cooling load heat exchanger for absorbing heat from the cooling load and rejecting that heat to a working gas, the cooling load heat exchanger comprising a bridging chamber having a flow path with a first opening disposed in fluid communication with the second end of the regenerator and a second opening disposed in fluid communication with the cold end of the pulse tube; and (e) a pressure wave generator for generating pressure wave oscillations in a working gas disposed within the regenerator proximate to the first end of the regenerator, the pressure wave oscillations having a displacement volume, whereby the pressure wave oscillations cause the working gas to flow serially through the regenerator, the cooling load heat exchanger and the pulse tube;

wherein the internal volume of the bridging chamber is less than the displacement volume of the flow of working gas generated by the pressure wave generator under conditions of low pressure drop through the bridging chamber; and wherein the direction of working gas flowing into and out of the first opening in the bridging chamber differs from the direction of working gas flowing into and out of the second opening in the bridging chamber by an angle of between about 0° and about 90°.

10. The pulse tube cooler as set forth in claim 9 wherein the internal gas volume of the bridging chamber is between about 2% to 10% of the volume generated by the compressor stroke.

11. The pulse tube cooler as set forth in claim 9 wherein the bridging chamber further comprises a plurality of fins disposed longitudinally within the bridging chamber between the first opening and the second opening so as to partition the bridging chamber into a plurality of parallel longitudinal channels of equal cross-section disposed between the first opening and the second opening.

12. The pulse tube cooler as set forth in claim 11 where the surface of the fins is determined by the channel width and the internal gas volume of the heat exchanger.

13. The pulse tube cooler as set forth in claim 11 wherein the channel width between adjoining fins is between about 0.07 mm and 0.4 mm.

14. The pulse tube cooler as set forth in claim 9 wherein the first opening is larger than the second opening.

15. A pulse tube cooler for cooling a cooling load comprising:

(a) a pulse tube having a cold end and a closed hot end;

(b) a hot end heat exchanger for removing heat from the pulse tube at a location proximate to the hot end of the pulse tube;

(c) a regenerator for absorbing heat from a working gas having a temperature warmer than that of the regenerator and for rejecting heat to a working gas having a temperature cooler than that of the regenerator, the regenerator having a first end and a second end;

(d) a cooling load heat exchanger for absorbing heat from the cooling load and rejecting that heat to a working gas, the cooling load heat exchanger comprising a bridging chamber with a flow path having an internal gas volume between about 2% and 10% of the volume of the compressor stroke, a first opening disposed in fluid communication with the second end of the regenerator and a second opening disposed in fluid communication with the cold end of the pulse tube, the cooling load heat exchanger further comprising a plurality of fins disposed longitudinally within the bridging chamber between the first opening and the second opening so as to partition the bridging chamber into a plurality of parallel longitudinal channels of equal cross-section disposed between the first opening and the second opening;

(e) a pressure wave generator for generating pressure wave oscillations in a working gas disposed immediately downstream of the pressure wave generator, the pressure wave oscillations generated by the pressure wave generator having a displacement volume larger than the internal volume of the cooling load heat exchanger, whereby the pressure wave oscillations cause the working gas to flow serially through the regenerator, the cooling load heat exchanger and the pulse tube; and wherein the first opening in the cooling load heat exchanger is larger than the second opening in the cooling load heat exchanger; and wherein the direction of working gas flowing into and out of the first opening in the bridging chamber differs from the direction of working gas flowing into and out of the second opening of the bridging by an angle of between about 0° and about 150° degrees.

16. The pulse tube cooler as set forth in claim 15 wherein the channel width is between about 0.07 mm and about 0.4 mm.

17. A cooling load heat exchanger for absorbing heat from a cooling load and rejecting that heat to a working gas flowing through the cooling load heat exchanger, the cooling load heat exchanger comprising a bridging chamber with a first opening, a second opening and an internal gas volume of between about 2% to 10% of the volume generated by the compressor stroke, the bridging chamber being configured so that the direction of working gas flowing into and out of the first opening differs from the direction of working gas flowing into and out of the second opening by an angle of between about 0° and about 150°, the cooling load heat exchanger further comprising a plurality of fins disposed longitudinally within the bridging chamber between the first opening and the second opening so as to partition the bridging chamber into a plurality of parallel longitudinal channels of equal cross-section disposed between the first opening and the second opening.

* * * * *